US010751867B2

(12) United States Patent
Iida et al.

(10) Patent No.: US 10,751,867 B2
(45) Date of Patent: Aug. 25, 2020

(54) HAMMER DRILL

(71) Applicant: MAKITA CORPORATION, Anjo-shi, Aichi (JP)

(72) Inventors: Hitoshi Iida, Anjo (JP); Masanori Furusawa, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 292 days.

(21) Appl. No.: 15/727,430

(22) Filed: Oct. 6, 2017

(65) Prior Publication Data

US 2018/0099395 A1 Apr. 12, 2018

(30) Foreign Application Priority Data

Oct. 7, 2016 (JP) ..... 2016-198988

(51) Int. Cl.
*B25D 16/00* (2006.01)
*B25D 17/04* (2006.01)
*H01H 9/06* (2006.01)

(52) U.S. Cl.
CPC ..... *B25D 16/006* (2013.01); *B25D 17/043* (2013.01); *H01H 9/06* (2013.01);
(Continued)

(58) Field of Classification Search
CPC ..... B25D 16/006; B25D 17/043; B25D 2216/0015; B25D 2250/261;
(Continued)

(56) References Cited

U.S. PATENT DOCUMENTS 6,550,545 B1 4/2003 Manschitz et al.
7,322,427 B2 * 1/2008 Shimma ..... B25D 16/006 173/170
(Continued)

FOREIGN PATENT DOCUMENTS

JP 2009-056589 A 3/2009
JP 4729159 B2 7/2011

OTHER PUBLICATIONS

Jun. 16, 2020 Office Action issued in Japanese Patent Application No. 2016-198988.

*Primary Examiner* — Chelsea E Stinson
(74) *Attorney, Agent, or Firm* — Oliff PLC

(57) ABSTRACT

A hammer drill includes a switch, an operation member, a lock member, a mode switching member and a linked member. The operation member is normally held in an OFF position and moves to an ON position in response to an external pressing operation. The lock member moves in response to an external operation between a locking position, where the lock member is capable of locking the operation member in the ON position, and a non-locking position, where the lock member is incapable of locking the operation member. The linked member moves to an allowing position for allowing a movement of the lock member when the mode switching member is switched to a switching position corresponding to a hammer mode, and moves to an inhibiting position for inhibiting the movement of the lock member when the mode switching member is switched to a switching position corresponding to a drill mode.

14 Claims, 8 Drawing Sheets

(52) U.S. Cl.
CPC ..... *B25D 2216/0015* (2013.01); *B25D 2216/0023* (2013.01); *B25D 2216/0038* (2013.01); *B25D 2250/261* (2013.01)

(58) Field of Classification Search
CPC .... B25D 2216/0038; B25D 2216/0023; B25F 1/00; H01H 9/06
USPC ..... 173/1, 2, 13, 18, 48
See application file for complete search history.

(56) References Cited

U.S. PATENT DOCUMENTS

| | | | | |
|---|---|---|---|---|
| 2006/0011361 | A1* | 1/2006 | Shimma | B25D 16/006 173/48 |
| 2009/0056965 | A1 | 3/2009 | Moessnang | |
| 2010/0236801 | A1* | 9/2010 | Furusawa | B25D 11/10 173/47 |

* cited by examiner

HAMMER DRILL

CROSS-REFERENCE TO RELATED APPLICATION

The present application claims priority to Japanese patent application No. 2016-198988 filed on Oct. 7, 2016, the contents of which are incorporated fully herein by reference.

TECHNICAL FIELD

The present invention generally relates to a hammer drill having a selectable plurality of drive modes including a hammer mode, in which only a hammering operation is performed to linearly drive a tool accessory in a direction of a drive axis, and a drill mode, in which at least a drilling operation is performed to rotationally drive the tool accessory around the drive axis, and is configured to operate according to selected one of the drive modes.

BACKGROUND

Hammer drills are known which are configured to operate according to a drive mode selected by a user from drive modes including a hammer mode (also referred to as a chisel mode) and a drill mode. Some of the hammer drills are configured to lock an operation member for a switch for driving a tool accessory in an ON position in order to keep the switch in an on-state in the hammer mode, and not to lock the operation member in the ON position in the drill mode. For example, in a hammer drill disclosed in Japanese Patent No. 4729159, when a lock member which is movable between a first operating position and a second operating position is moved to the first operating position in the hammer mode, a return path of an operation member to an OFF position is blocked. Thus, the operation member is locked in the ON position.

SUMMARY

In the above-described hammer drill, in the drill mode, even if the lock member is moved to the first operating position, the return path of the operation member to the OFF position is not blocked, so that the operation member returns to the OFF position. In this case, an operation of moving the lock member to the first operating position is not associated with an actual locked state of the operation member. As a result, user's recognition may be different from the actual result of the operation, which may lead to deterioration of the operational feeling.

Accordingly, it is an object of the present teachings to provide a technique that may contribute to improvement of a user's operational feeling, relating to a structure for locking an operation member of a switch in an ON position, in a hammer drill which is configured to operate according to a drive mode selected by a user from among a plurality of drive modes including a hammer mode and a drill mode.

According to one aspect of the present teachings, a hammer drill is provided. The hammer drill has a selectable plurality of drive modes, including a hammer mode and a drill mode. The hammer mode is a drive mode in which only a hammering operation to linearly drive a tool accessory in a direction of a drive axis is performed. The drill mode is a drive mode in which at least a drilling operation to rotationally drive the tool accessory around the drive axis is performed. The hammer drill is configured to operate according to selected one of the drive modes. The hammer drill includes a switch, an operation member, a lock member, a mode switching member and a linked member.

The switch is configured as a switch for driving the tool accessory. The operation member is configured to be normally held in an OFF position, and to move to an ON in response to an external pressing operation. The operation member in the OFF position holds the switch in an off-state, and the operation member in the ON position holds the switch in an on-state. The lock member is configured to move between a locking position and a non-locking position in response to an external operation. The lock member in the locking position is capable of locking the operation member in the ON position. The lock member in the non-locking position is incapable of locking the operation member in the ON position. The mode switching member is configured to be switched among a plurality of switching positions in response to an external operation. The plurality of switching positions respectively correspond to the plurality of drive modes.

The linked member is configured to move between an inhibiting position and an allowing position, linked to a switching operation of the mode switching member. The linked member in the inhibiting position inhibits a movement of the lock member. The linked member in the allowing position allows the movement of the lock member. Further, the linked member is configured to move to the allowing position when the mode switching member is switched to one of the switching positions corresponding to the hammer mode, and to move to the inhibiting position when the mode switching member is switched to one of the switching positions corresponding to the drill mode. It is noted that the "drill mode in which at least a drilling operation to rotationally drive the tool accessory around the drive axis is performed" includes: a drive mode in which only the drilling operation is performed; a drive mode in which both the drilling operation and the hammering operation are performed; and a drive mode in which the drilling operation and another operation other than the hammering operation are performed.

The term "a movement" as used herein relating to the operation member, the lock member and the linked member refers to a locational or spatial movement and does not include an electrical switching.

According to the present aspect, when the hammer mode is selected with the mode switching member, the linked member moves to the allowing position. Therefore, the user can lock the operation member in the ON position by moving the lock member to the locking position. On the other hand, when a drive mode (such as a drill mode) other than the hammer mode is selected with the mode switching member, the linked member moves to the inhibiting position. Therefore, the user cannot move the lock member to the locking position, even if the user tries to do so. This allows the user to intuitively and directly recognize that it is impossible to lock the operation member in the ON position in the selected drive mode other than the hammer mode. Therefore, an interactive working environment is provided, so that the user's operation feeling can be improved.

According to another aspect of the present teachings, the hammer drill may further include a biasing member that biases the lock member so as to hold the lock member in the non-locking position. The lock member may be configured to lock the operation member in the ON position by abutting against the operation member when the lock member is placed in the locking position against the biasing force of the biasing member. In this case, even when the linked member is placed in the allowing position, the lock member is held in the non-locking position unless the lock member is moved to the locking position against the biasing force of the biasing member. Therefore, the operation member can be prevented from being locked in the ON position when not intended by the user. Further, when the lock member is disengaged from the operation member, the lock member can be returned from the locking position to the non-locking position by the biasing force of the biasing member.

According to another aspect of the present teachings, the lock member may be configured to move in a crossing direction crossing the drive axis, and configured such that both ends of the lock member in the crossing direction are externally operable. The lock member may be further configured to move between another locking position and the non-locking position. The locking position and the other locking position may be provided on opposite sides of the non-locking position in the crossing direction. When the lock member is held in the non-locking position by the biasing member, the user can lock the operation member in the ON position by operating the lock member from either side in the crossing direction thereby moving the lock member to one of the locking positions. Consequently, operability can be improved.

According to another aspect of the present teachings, the linked member may be configured to move in the direction of the drive axis, linked to the switching operation of the mode switching member. Further, the lock member may be configured to move in a crossing direction crossing the drive axis. The linked member may have a wider part having a prescribed width in the crossing direction and a narrower part having a narrower width than the prescribed width in the crossing direction. The wider part may be configured to come in contact with the lock member in the crossing direction to thereby inhibit the lock member from moving in the crossing direction when the linked member is placed in the inhibiting position. The narrower part may be configured to be spaced apart from the lock member in the crossing direction to thereby allow the lock member to move in the crossing direction when the linked member is placed in the allowing position. In this case, with the simple structure of providing the linked member with the wider part and the narrower part, the movement of the lock member which is movable in the crossing direction can be inhibited or allowed simply by moving the linked member to the inhibiting position or the allowing position in the drive axis direction.

According to another aspect of the present teachings, the hammer drill may further include a driving mechanism, a first housing, and a second housing. The driving mechanism may be configured to drive the tool accessory. The first housing may house the driving mechanism. The second housing may include a grip part configured to be held by a user, and may be connected to the first housing via an elastic element such that the second housing is movable relative to the first housing. The mode switching member may be provided to the first housing. The linked member may be connected to the mode switching member such that the linked member moves in conjunction with the mode switching member. The lock member may be provided to the second housing. The linked member may have an interference preventing part configured to prevent the linked member and the lock member from interfering with each other in a direction of a relative movement of the first and second housings when the linked member is placed in the allowing position and the second housing moves with respect to the first housing.

In this case, with the structure in which the second housing having the grip part is connected to the first housing via the elastic element in a relatively movable manner, transmission of vibration from the first housing to the second housing can be suppressed, even when the vibration is caused by driving of the driving mechanism. When the first housing vibrates, however, the linked member connected to the mode switching member also vibrates and may interfere with the lock member provided to the second housing. As a countermeasure, by providing the interference preventing part in the linked member, it may be possible to prevent the lock member from interfering with the linked member and thus from being inhibited from moving when the linked member is placed in the allowing position.

DETAILED DESCRIPTION OF THE EMBODIMENTS

Figure 1:
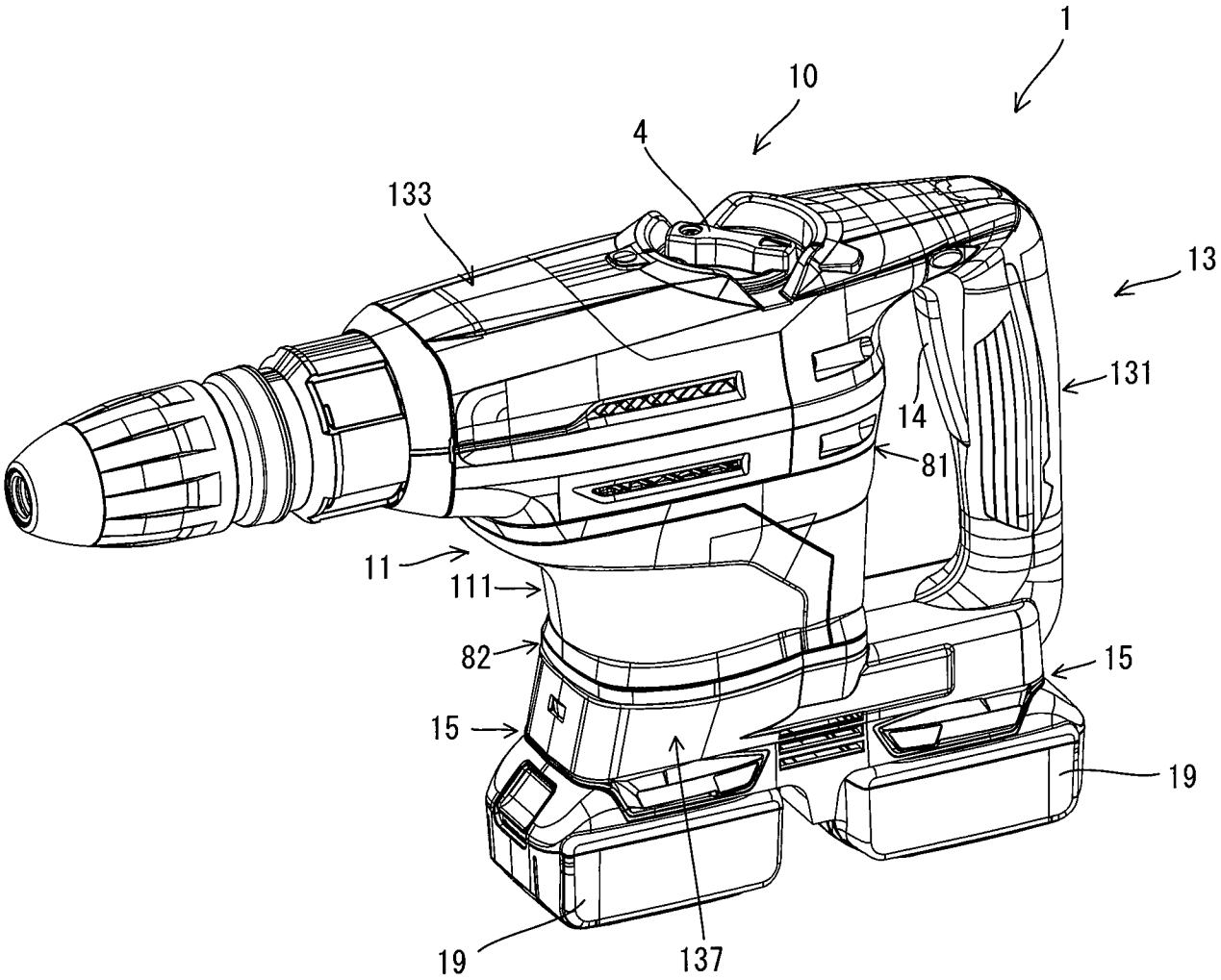
FIG. 1 is a perspective view showing an external appearance of the hammer drill.

An embodiment of the present teachings is now explained with reference to the drawings. In the following embodiment, a hammer drill 1 is described as an example. The hammer drill 1 of this embodiment is configured to perform an operation (a hammering operation) of linearly driving a tool accessory 18 coupled to a tool holder 34 along a prescribed drive axis A1, and an operation (drilling operation) of rotationally driving the tool accessory 18 around the drive axis A1.

The structure of the hammer drill 1 is briefly described with reference to FIGS. 1 and 2. An outer shell of the hammer drill 1 is mainly formed by a housing 10. The housing 10 of this embodiment is configured as a so-called vibration-isolating housing. The housing 10 includes a first housing 11 and a second housing 13 which is elastically connected to the first housing 11 such that the second housing 13 is movable relative to the first housing 11.

Figure 2:
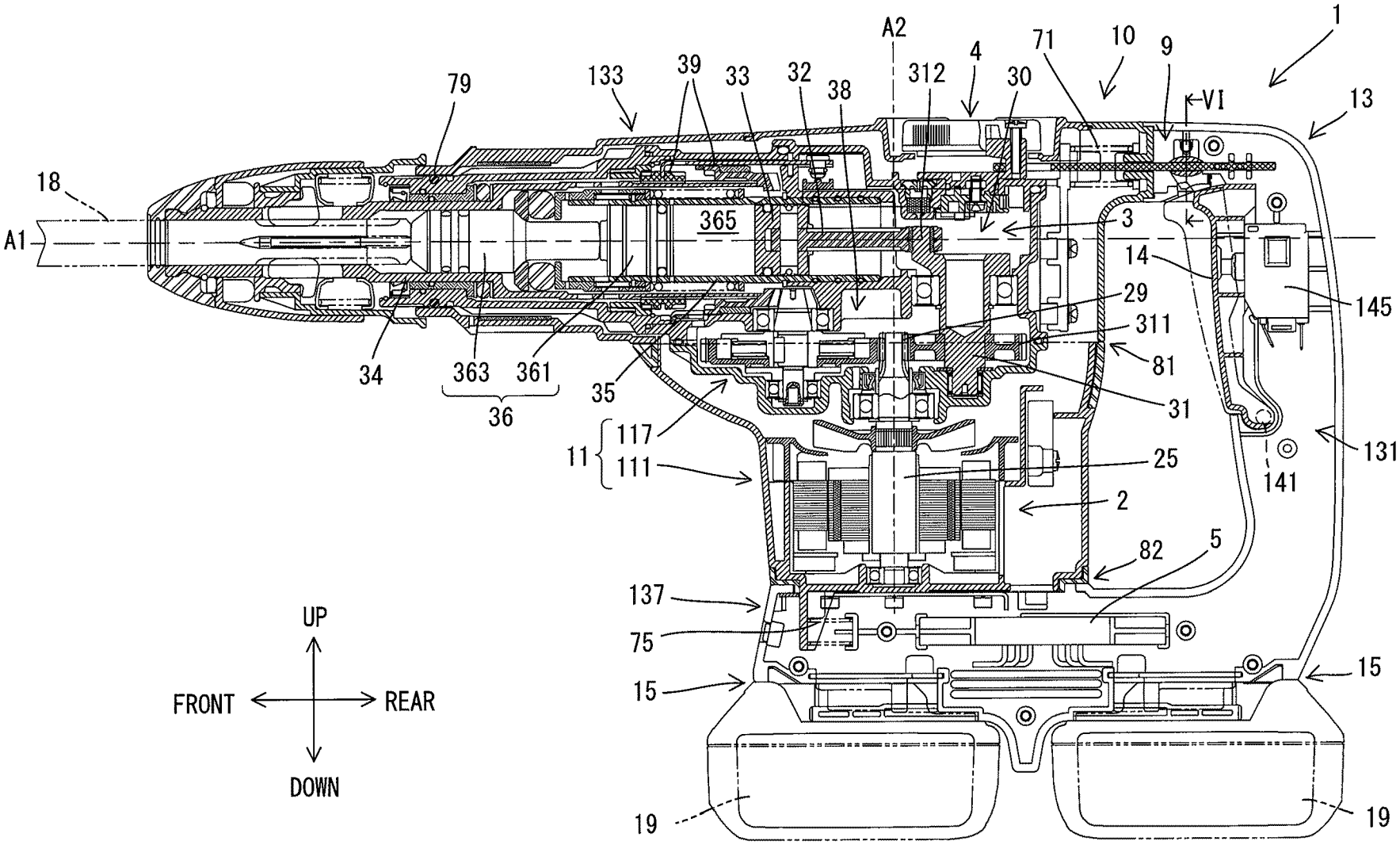
FIG. 2 is a longitudinal sectional view of the hammer drill.

As shown in FIG. 2, the first housing 11 includes a motor housing part 111 that houses a motor 2, and a driving mechanism housing part 117 that houses a driving mechanism 3 configured to drive the tool accessory 18 by the power of the motor 2. The first housing 11 is generally L-shaped as a whole. The driving mechanism housing part 117 has an elongate shape extending in a direction of the drive axis A1. A tool holder 34 to which the tool accessory 18 is removably attached is disposed in one end region of the driving mechanism housing part 117 in the direction of the drive axis A1. The motor housing part 111 is fixedly connected in a relatively immovable manner to the other end region of the driving mechanism housing part 117 in the direction of the drive axis A1. Further, the motor housing part 111 is arranged to protrude in a direction crossing the drive axis A1 and away from the drive axis A1. The motor 2 is disposed in the motor housing part 111 such that a rotation axis A2 of a motor shaft 25 extends in a direction perpendicular to the drive axis A1.

In the following description, for the sake of explanation, the direction of the drive axis A1 of the hammer drill 1 is defined as a front-rear direction of the hammer drill 1. One end side of the hammer drill 1 on which the tool holder 34 is provided is defined as a front side (also referred to as a front end region side) of the hammer drill 1 and the opposite side is defined as a rear side. Further, an extending direction of the rotation axis A2 of the motor shaft 25 is defined as an up-down direction of the hammer drill 1, a direction in which the motor housing part 111 protrudes from the driving mechanism housing part 117 is defined as a downward direction and the opposite direction is defined as an upward direction.

The second housing 13 includes a grip part 131, an upper part 133 and a lower part 137. The second housing 13 is generally U-shaped as a whole. The grip part 131 is configured to be held by a user and arranged to extend in a direction of the rotation axis A2 of the motor shaft 25 (i.e., in the up-down direction). More specifically, the grip part 131 is arranged apart rearward from the first housing 11 and extends in the up-down direction. The upper part 133 is connected to an upper end portion of the grip part 131. In this embodiment, the upper part 133 is configured to extend forward from the upper end portion of the grip part 131 and cover the most part of the driving mechanism housing part 117 of the first housing 11. The lower part 137 is connected to a lower end portion of the grip part 131. In this embodiment, the lower part 137 extends forward from the lower end portion of the grip part 131 and is arranged on a lower side of the motor housing part 111.

With the above-described structure, as shown in FIG. 1, in the hammer drill 1, the motor housing part 111 of the first housing 11 is arranged between the upper part 133 and the lower part 137 in the up-down direction and exposed to the outside and forms an outer surface of the hammer drill 1 together with the second housing 13. Further, the second housing 13 is connected to the first housing 11 via an elastic element. Moreover, the upper and lower parts 133, 137 are configured to be slidable relative to the upper and lower end portions of the motor housing part 111, respectively. More specifically, a lower surface of the upper part 133 and an upper end surface of the motor housing part 111 are configured as sliding surfaces to make sliding contact with each other in the direction of the drive axis A1, and form an upper sliding part 81. Further, an upper surface of the lower part 137 and a lower end surface of the motor housing part 111 are configured as sliding surfaces to make sliding contact with each other in the direction of the drive axis A1, and form a lower sliding part 82.

Two battery mounting parts 15 to which respective rechargeable batteries 19 are removably attached are provided on a lower end portion of the lower part 137. In this embodiment, the two battery mounting parts 15 are arranged side by side in the front-rear direction. Further, the hammer drill 1 operates by power supply from the two batteries 19 mounted to the battery mounting parts 15.

The structure of the hammer drill 1 is now explained in detail with reference to FIGS. 1 to 8.

First, the internal structure of the first housing 11 is explained with reference to FIG. 2. As shown in FIG. 2, in this embodiment, the motor housing part 111 of the first housing 11 has a rectangular-tube shape with a closed bottom and an open upper end. A lower end region of a rear part of the driving mechanism housing part 117 is disposed within an upper end region of the motor housing part 111, and the driving mechanism housing part 117 is fixedly connected to the motor housing part 111 in a relatively immovable manner. In this embodiment, a compact and high-output brushless motor is employed as the motor 2 and housed in the motor housing part 111. The motor shaft 25 which extends in the up-down direction is rotatably supported at its upper and lower end portions by bearings. A driving gear 29 is provided on the upper end portion of the motor shaft 25 which protrudes into the driving mechanism housing part 117.

In this embodiment, the driving mechanism housing part 117 of the first housing 11 houses a driving mechanism 3 that includes a motion converting mechanism 30, a striking mechanism 36 and a rotation transmitting mechanism 38.

The motion converting mechanism 30 is configured to convert rotational motion of the motor 2 into linear motion and then transmit it to the striking mechanism 36. The motion converting mechanism 30 of this embodiment is configured as a crank mechanism and includes a crank shaft 31, a connecting rod 32, a piston 33 and a cylinder 35. The crank shaft 31 is arranged in parallel to the motor shaft 25 in a rear end region of the driving mechanism housing part 117. The crank shaft 31 has a driven gear 311 which is engaged with the driving gear 29, on its lower end portion, and a crank pin 312 on its upper end portion. One end portion of the connecting rod 32 is rotatably connected to the crank pin 312 and the other end portion is mounted to the piston 33 via a pin. The piston 33 is slidably disposed within the circular-cylindrical cylinder 35. The cylinder 35 is coaxially and fixedly connected to a rear part of the tool holder 34 which is disposed within the front end region of the driving mechanism housing part 117. When the motor 2 is driven, the piston 33 is caused to reciprocate within the cylinder 35 in the direction of the drive axis A1.

The striking mechanism 36 includes a striker 361 and an impact bolt 363. The striker 361 is disposed within the cylinder 35 so as to be slidable in the direction of the drive axis A1. An air chamber 365 is formed between the striker 361 and the piston 33 for linearly moving a striking element in the form of the striker 361 via air pressure fluctuations caused by the reciprocating motion of the piston 33. The impact bolt 363 is configured as an intermediate element for transmitting kinetic energy of the striker 361 to the tool accessory 18. The impact bolt 363 is disposed within the tool holder 34 so as to be slidable in the direction of the drive axis A1.

When the motor 2 is driven and the piston 33 is moved forward, the air in the air chamber 365 is compressed so that the internal pressure increases. Therefore, the striker 361 is pushed forward at high speed and collides with the impact bolt 363, thereby transmitting its kinetic energy to the tool accessory 18. As a result, the tool accessory 18 is linearly driven along the drive axis A1 and strikes a workpiece. On the other hand, when the piston 33 is moved rearward, the air in the air chamber 365 expands so that the internal pressure decreases and the striker 361 is retracted rearward. The hammer drill 1 performs a hammering operation by causing the motion converting mechanism 30 and the striking mechanism 36 to repeatedly perform such operations.

The rotation transmitting mechanism 38 is configured to transmit the rotating power of the motor shaft 25 to the tool holder 34. In this embodiment, the rotation transmitting mechanism 38 is configured as a gear speed reducing mechanism including a plurality of gears. The rotation transmitting mechanism 38 appropriately decelerates the rotational speed of the motor 2 and transmits the rotational power to the tool holder 34. Further, an engagement clutch 39 is disposed on a power transmission path of the rotation transmitting mechanism 38. When the clutch 39 is engaged, the rotational power of the motor shaft 25 is transmitted to the tool holder 34 via the rotation transmitting mechanism 38, so that the tool accessory 18 coupled to the tool holder 34 is rotationally driven around the drive axis A1. When the clutch 39 is disengaged (as shown in FIG. 2), the power transmission to the tool holder 34 via the rotation transmitting mechanism 38 is interrupted, so that the tool accessory 18 is not rotationally driven.

The hammer drill 1 of this embodiment is configured such that one of two drive modes, that is, a hammer mode and a hammer drill mode, can be selected by operating a mode switching dial 4, which is rotatably disposed on the top part of the driving mechanism housing part 117. The hammer mode is a drive mode in which the clutch 39 is disengaged and only the motion converting mechanism 30 is driven, so that only the hammering operation is performed. The hammer drill mode is a drive mode in which the clutch 39 is engaged and the motion converting mechanism 30 and the rotation transmitting mechanism 38 are driven, so that both the hammering operation and the drilling operation are performed.

The mode switching dial 4 has switching positions respectively set for the hammer drill mode and the hammer mode in its circumferential direction. A clutch switching mechanism is provided within the first housing 11 and connected to the mode switching dial 4 so as to switch the clutch 39 between the engaged state and the disengaged state, according to the switching position selected with the mode switching dial 4. The structure of the clutch switching mechanism is well-known, and therefore it is not described in further detail and not shown in the drawings here.

The internal structure of the second housing 13 is now explained with reference to FIGS. 1 to 3. As shown in FIGS. 1 and 2, a rear part of the upper part 133 has a generally rectangular box-like shape having an open bottom. The rear part of the upper part 133 covers a rear part of the driving mechanism housing part 117 (more specifically, a part of the driving mechanism housing part 117 in which the motion converting mechanism 30 and the rotation transmitting mechanism 38 are housed) from above. Further, a front part of the upper part 133 has a circular-cylinder shape and covers an outer periphery of a front part of the driving mechanism housing part 117 (more specifically, a part of the driving mechanism housing part 117 in which the tool holder 34 is housed).

An opening 134 is formed in the top face of the rear part of the upper part 133 such that the mode switching dial 4 provided on the top part of the driving mechanism housing part 117 is exposed to the outside through the opening 134. A trigger lock mechanism 9 connected to the mode switching dial 4 is disposed within the rear part of the upper part 133. The trigger lock mechanism 9 is configured to lock a trigger 14 (which is described below) in an ON position when the hammer mode is selected by a user by way of an operation of the mode switching dial 4. The trigger lock mechanism 9 is described below in further detail.

Figure 3:
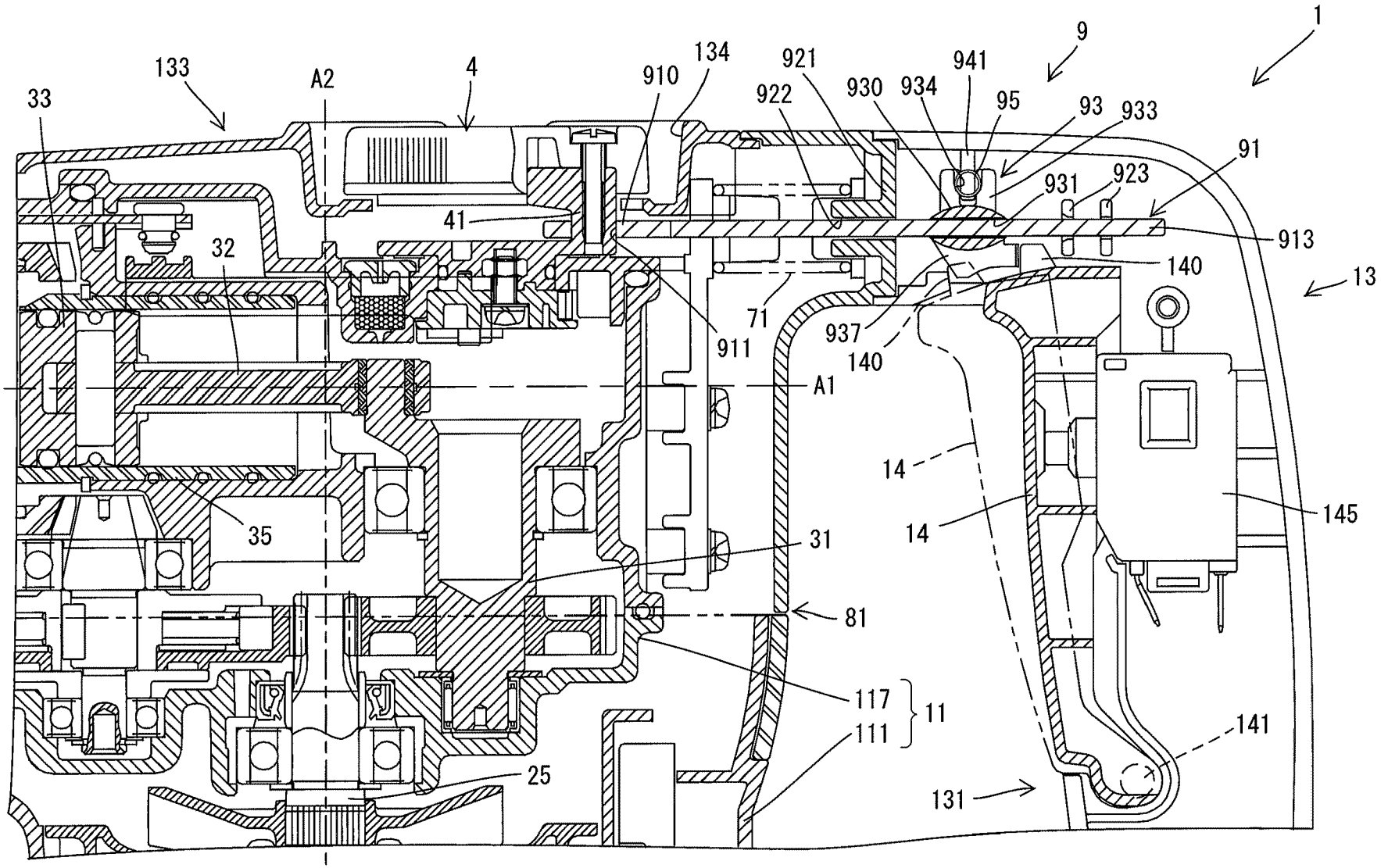
FIG. 3 is an enlarged view of an upper rear end portion in FIG. 2.

As shown in FIG. 3, the trigger 14 which can be pressed by the user is provided on a front part of the grip part 131. The trigger 14 is configured to be turned (rotated) around a support shaft 141 extending in a left-right direction, within a prescribed turning range in the front-rear direction. The trigger 14 is normally held in a foremost position (a position shown by two-dot chain line in FIG. 3) within the turning range in a state in which the trigger 14 is biased forward by a plunger of a switch 145 which is described below. The trigger 14 has a locking projection 140 protruding upward from an upper end of the trigger 14. The locking projection 140 is configured to be engaged with a lock member 93 which is described below. This structure is described below in detail.

A switch 145 is disposed within the cylindrical grip part 131. The switch 145 is configured to be switched between an on-state and an off-state in response to an operation of the trigger 14. In an initial state in which the trigger 14 is placed in the foremost position, a movable contact of the switch 145 does not come in contact with a fixed contact of the switch 145, so that the switch 145 is held in the off-state. This foremost position is hereinafter also referred to as an OFF position. When the trigger 14 is pressed and turned rearward to a specific position (a position shown by solid line in FIG. 3) within the turning range, the movable contact is brought in contact with the fixed contact along with a movement of the plunger of the switch 145, so that the switch 145 is turned to the on-state. This specific position is also referred to as the ON position. Further, in this embodiment, the rearmost position of the trigger 14 within the turning range is set rearward of the ON position. The switch 145 is held in the off-state when the trigger 14 is placed between the OFF position (foremost position) and the ON position within the turning range, while the switch 145 is held in the on-state when the trigger 14 is placed between the ON position and the rearmost position.

As shown in FIG. 2, the lower part 137 has a rectangular box-like shape having a partially open top and is arranged on the lower side of the motor housing part 111. As described above, the two battery mounting parts 15 are provided on the lower end portion of the lower part 137 of the second housing 13 and disposed side by side in the front-rear direction. The batteries 19 are mounted on the lower sides of the respective battery mounting parts 15. A controller 5 is disposed above the battery mounting parts 15. The controller 5 is electrically connected to the motor 2, the switch 145 and the battery mounting parts 15 via wiring (not shown). The controller 5 is configured to start energization of the motor 2 (that is, driving of the tool accessory 18) in response to an electric signal outputted from the switch 145, correspondingly to the on-state and to stop energization of the motor 2 in response to an electric signal outputted from the switch 145 correspondingly to the off-state.

A vibration-isolating housing structure of the housing 10 is now explained with reference to FIG. 2. As described above, in the housing 10, the second housing 13 including the grip part 131 is elastically connected to the first housing 11 which houses the motor 2 and the driving mechanism 3, in a relatively movable manner. Consequently, transmission of vibration from the first housing 11 to the second housing 13 (particularly, the grip part 131) can be suppressed.

More specifically, as shown in FIG. 2, a pair of right and left first springs 71 are disposed between the driving mechanism housing part 117 of the first housing 11 and the upper part 133 of the second housing 13. Although only the right first spring 71 is shown in FIG. 2, the left first spring 71 has the same structure as the right first spring 71. Further, a second spring 75 is disposed between the motor housing part 111 of the first housing 11 and the lower part 137 of the second housing 13. With this structure, the first housing 11 and the second housing 13 are elastically connected to each other in an upper end side and a lower end side of the grip part 131 via the first springs 71 and the second spring 75.

In this embodiment, all of the first springs 71 and the second spring 75 are configured as compression coil springs. The first springs 71 and the second spring 75 bias the first housing 11 and the second housing 13, such that the grip part 131 is biased away from the first housing 11 in the direction of the drive axis A1. In addition to these springs, an O-ring 79 formed of an elastic material is disposed between a front end portion of the driving mechanism housing part 117 and a cylindrical front part of the upper part 133.

In this embodiment, as described above, the housing 10 has the upper sliding part 81 and the lower sliding part 82. The upper sliding part 81 and the lower sliding part 82 each serve as a sliding guide for guiding the first housing 11 and the second housing 13 to move relative to each other in the direction of the drive axis A1. With this structure, transmission to the grip part 131 of the vibration in the direction of the drive axis A1, which is the largest and most dominant vibration caused by the hammering operation, can be effectively suppressed.

The trigger lock mechanism 9 is now explained in detail with reference to FIGS. 3 to 8. In this embodiment, the trigger lock mechanism 9 includes a linked member 91 and a lock member 93, whose structures are now described.

Figure 4:
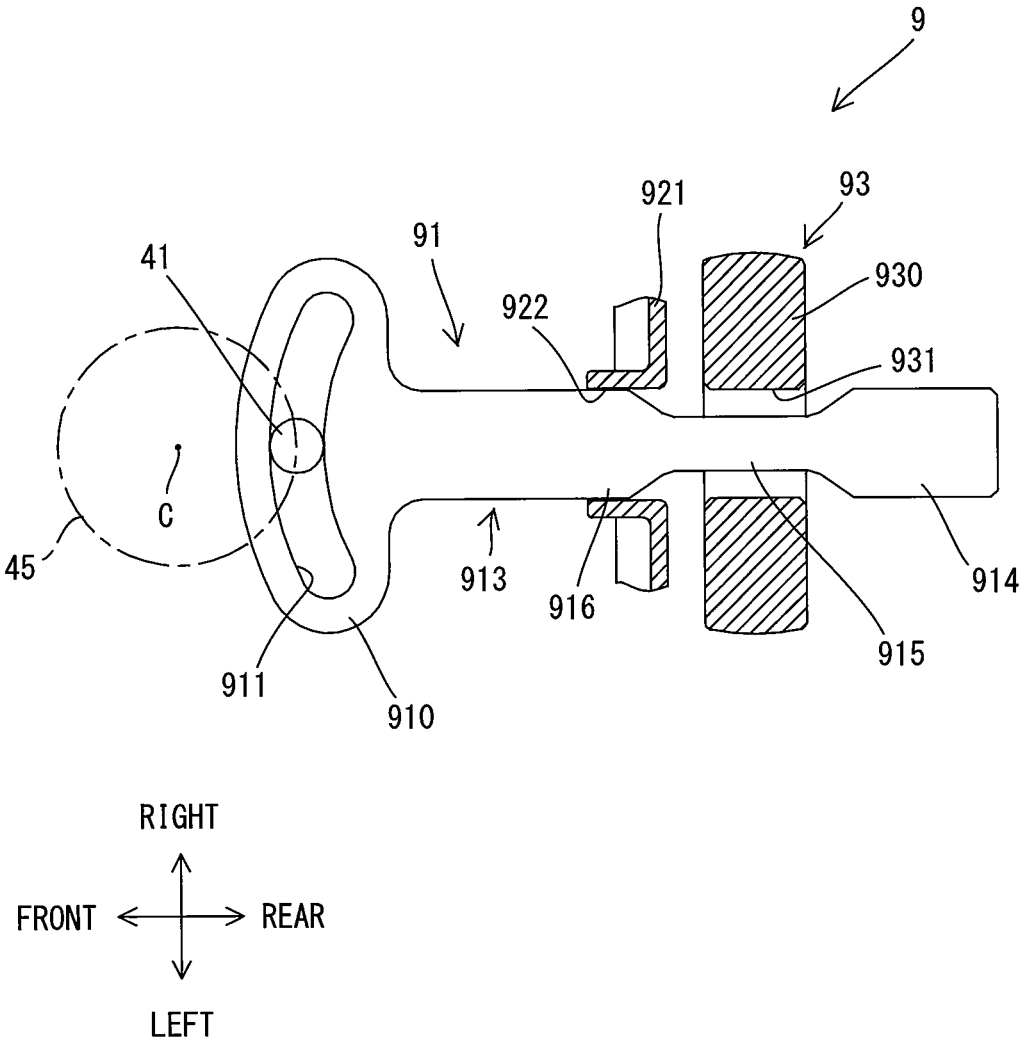
FIG. 4 is an explanatory drawing for illustrating an arrangement of a trigger lock mechanism in a state in which a hammer mode is selected.

The linked member 91 is configured to move, linked to (in conjunction with) a switching operation of the mode switching dial 4. In this embodiment, as shown in FIGS. 3 and 4, the linked member 91 is configured as an elongate plate member which is arranged to extend in the direction of the drive axis A1 (the front-rear direction). The linked member 91 includes a connection part 910 and an actuation part 913.

The connection part 910 is connected to the mode switching dial 4 such that the connection part 910 is movable relative to the mode switching dial 4. The connection part 910 is a front end portion of the linked member 91 and has a circular-arc shape bulging forward. The connection part 910 has a guide hole 911 formed as an elongated hole having a circular-arc shape, corresponding to the shape of the connection part 910. The mode switching dial 4 has a columnar eccentric shaft 41 which protrudes downward from a position deviated by a prescribed distance from a rotation center C of the mode switching dial 4. The eccentric shaft 41 extends through the guide hole 911 in the up-down direction. The eccentric shaft 41 is slidable within the guide hole 911.

The actuation part 913 linearly protrudes rearward from a central part of the circular-arc connection part 910 and extends in the direction of the drive axis A1 (front-rear direction). The actuation part 913 includes a wider part 914 having a prescribed width in the left-right direction, a narrower part 915 having a narrower width than the wider part 914 in the left-right direction, and a guide part 916 having the same width as the wider part 914 in the left-right direction. The wider part 914 is configured to come in contact with the lock member 93 in the left-right direction to thereby inhibit the lock member 93 from moving in the left-right direction, which is described below in detail. The wider part 914 forms a rear end portion of the actuation part 913. The narrower part 915 is configured to face the lock member 93 with a spacing in the left-right direction to thereby allow the lock member 93 to move in the left-right direction. The guide part 916 is configured to guide the linked member 91 to move in the front-rear direction in cooperation with a guide wall 921 which is described below. The guide part 916 forms a front end portion of the actuation part 913 and the narrower part 915 forms a portion of the actuation part 913 between the wider part 914 and the guide part 916.

In this embodiment, the linked member 91 is arranged to be movable in the direction of the drive axis A1 (front-rear direction) within a prescribed movement range. For this reason, the guide wall 921 is provided in a rear end region of the upper part 133 of the second housing 13. The guide wall 921 is arranged to extend perpendicularly to the front-rear direction. A passage 922 extends through the guide wall 921 in the front-rear direction, in the center region of the guide wall 921 in the left-right direction. The passage 922 is configured such that the actuation part 913 of the linked member 91 can slide through the passage 922 in the front-rear direction. The height of the passage 922 in the up-down direction is substantially equal to the thickness of the actuation part 913 in the up-down direction, and the width of the passage 922 in the left-right direction is substantially equal to the width of the wider part 914 and the guide part 916 in the left-right direction.

The actuation part 913 is always disposed in the passage 922. Further, a locking hole 931 of the lock member 93 extends behind the passage 922, which is described below in detail. Moreover, two guide ribs 923 (see FIG. 3) are provided behind the lock member 93 within the rear end region of the upper part 133. Each of the guide ribs 923 has a recess through which a rear end portion of the actuation part 913 of the linked member 91 can pass. With this structure, when the mode switching dial 4 is turned (rotated) around the rotation center C, the linked member 91 is moved in the front-rear direction while sliding in the passage 922, by a front-rear directional component of rotation of the eccentric shaft 41.

Figure 5:
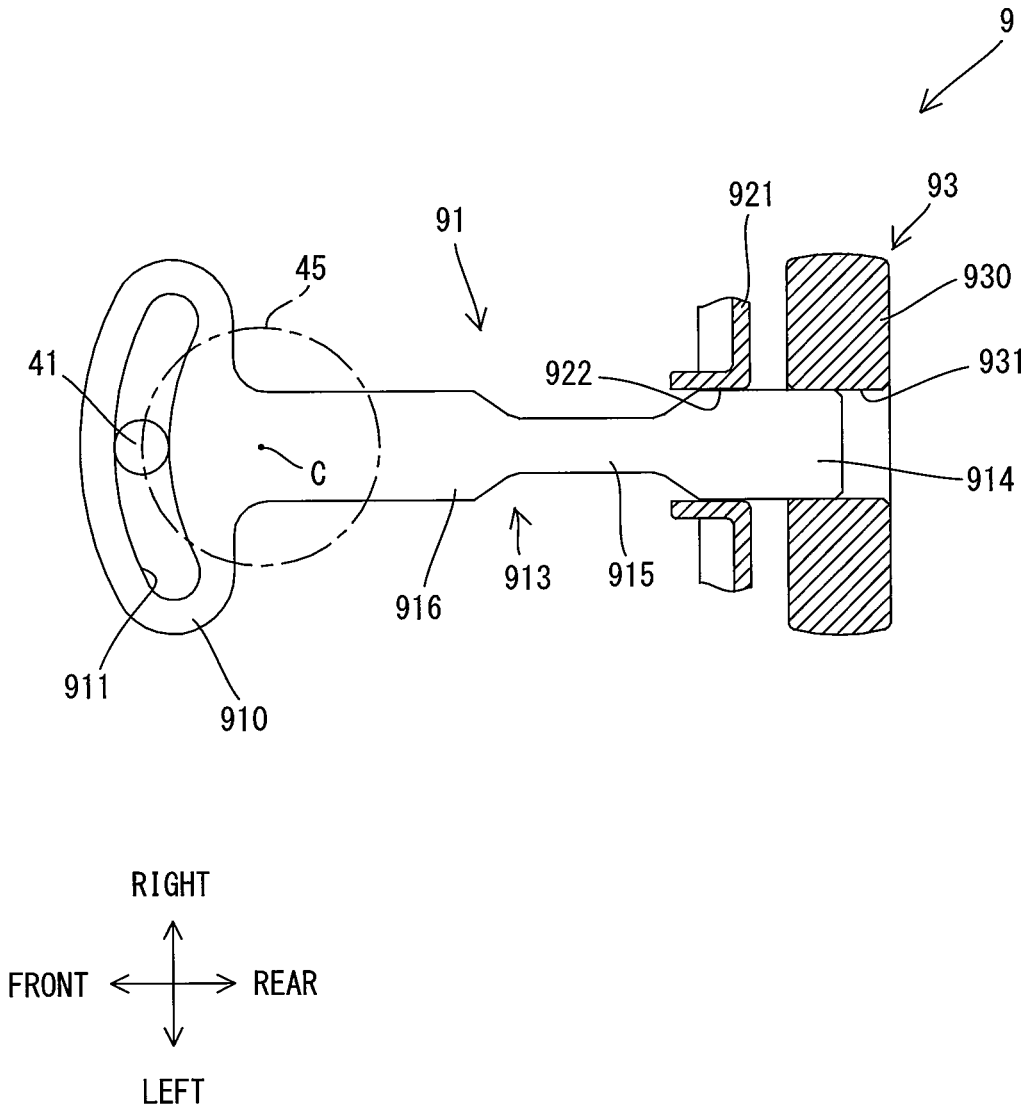
FIG. 5 is an explanatory drawing for illustrating an arrangement of the trigger lock mechanism in a state in which a hammer drill mode is selected.

The relationship between a switching position of the mode switching dial 4 and a position of the linked member 91 is now explained with reference to FIGS. 4 and 5. When the mode switching dial 4 is switched to a switching position corresponding to the hammer mode (hereinafter referred to as a hammer-mode position), as shown in FIG. 4, the eccentric shaft 41 is placed in a rearmost position on a rotation path 45 and the linked member 91 is also placed in a rearmost position within the movement range. When the mode switching dial 4 is switched to a switching position corresponding to the hammer drill mode (hereinafter referred to as a hammer-drill-mode position), as shown in FIG. 5, the eccentric shaft 41 is placed in a foremost position on the rotation path 45 and the linked member 91 is also placed in a foremost position within the movement range.

The lock member 93 is configured to lock the trigger 14 in the ON position and arranged to allow an external operation by a user. In this embodiment, the lock member 93 includes a body 930, a spring holding part 933 and a trigger locking part 937.

Figure 6:
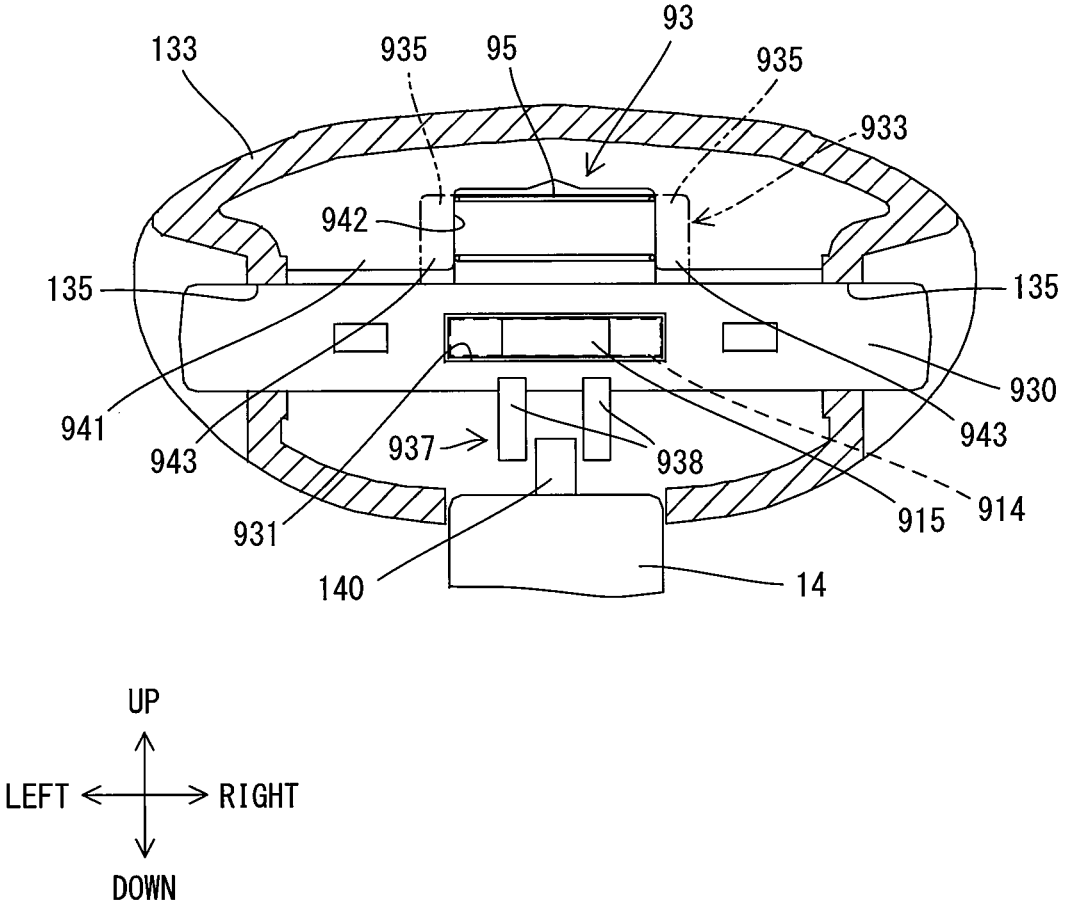
FIG. 6 is a sectional view taken along line VI-VI in FIG. 2, for illustrating a state in which a trigger is placed in a foremost position (OFF position) and a lock member is placed in a non-locking position.

As shown in FIGS. 3, 4 and 6, the body 930 has a rod-like shape extending in the left-right direction. The body 930 has the locking hole 931 formed in its center and extending through the body 930 in the front-rear direction. The height of the locking hole 931 in the up-down direction is substantially equal to the thickness of the actuation part 913 in the up-down direction, and the width of the locking hole 931 in the left-right direction is substantially equal to the width of the wider part 914 in the left-right direction.

As shown in FIGS. 3 and 6, the spring holding part 933 protrudes upward from an upper end portion of the body 930 and is configured to hold a biasing member 95. The spring holding part 933 has a recess 934 extending in the left-right direction and having a U-shape in a side view. Each of left and right end portions of the spring holding part 933 includes a stopper part 935 slightly protruding into the recess 934. In this embodiment, the biasing member 95 is configured as a compression coil spring. The biasing member 95 is compressed and held within the recess 934 of the spring holding part 933 while left and right ends of the biasing member 95 are held in contact with the stopper parts 935.

The trigger locking part 937 is configured to be engageable with the locking projection 140 of the trigger 14. In this embodiment, as shown in FIG. 6, the trigger locking part 937 includes two projection pieces 938 projecting downward from a lower end portion of the body 930. The projection pieces 938 are spaced apart from each other in the left-right direction and the distance between the projection pieces 938 is set longer than the width of the locking projection 140 of the trigger 14 in the left-right direction.

The lock member 93 having the above-described structure is arranged so as to be to movable in the left-right direction crossing the direction of the drive axis A1 in the rear end region of the upper part 133. More specifically, through holes 135 are formed in left and right walls of the upper part 133, respectively, behind the guide wall 921, and the lock member 93 is disposed in the upper part 133 such that left and right end portions of the body 930 protrude to the outside through the left and right through holes 135.

Further, as shown in FIG. 3, a restricting wall 941 is formed on an upper wall of the upper part 133. The restricting wall 941 protrudes downward, facing the recess 934 of the spring holding part 933. As shown in FIG. 6, the restricting wall 941 has a recess 942 formed in its central part and recessed upward to a position corresponding to an upper end of the spring holding part 933. The width of the recess 942 in the left-right direction is set substantially equal to the distance in the left-right direction between the stopper parts 935 formed on the left and right end portions of the spring holding part 933. Therefore, normally, spring pressing parts 943 of the restricting wall 941 which define left and right ends of the recess 942 protrude into the recess 934 so as to be aligned with the stopper parts 935 in the front-rear direction, and come in contact with the left and right ends of the biasing member 95.

In this manner, by the biasing force of the biasing member 95 held between the spring pressing parts 943, the lock member 93 is normally prevented from moving in the left-right direction and held in a position where a center of the lock member 93 in the left-right direction coincides with a center of the upper part 133 in the left-right direction. At this time, the locking projection 140 of the trigger 14 is located between the two projection pieces 938 of the trigger locking part 937 in the left-right direction. Therefore, when the trigger 14 is turned (rotated) in the front-rear direction between the foremost position and the rearmost position, the locking projection 140 of the trigger 14 does not come in contact with the projection pieces 938 at any position within the turning range. In other words, the projection pieces 938 are located in positions deviated from a movement path along which the locking projection 140 of the trigger 14 moves. Thus, the lock member 93 is held in a non-locking position in which the lock member 93 is incapable of locking the trigger 14 in the ON position.

When a left or right end portion of the body 930 protruding to the outside of the upper part 133 through the through hole 135 is pressed by the user, the lock member 93 is moved in the left-right direction against the biasing force of the biasing member 95. In this case, when the trigger locking part 937 of the lock member 93 is moved to a locking position on the movement path of the locking projection 140, the trigger 14 can be locked at the ON position. In this embodiment, however, whether the lock member 93 is allowed to move or not depends on the position of the linked member 91, in other words, the drive mode selected with the mode switching dial 4, which is now described in detail with reference to FIGS. 4 to 8.

As shown in FIG. 5, when the mode switching dial 4 is switched to the hammer-drill-mode position, the linked member 91 is moved to the foremost position as described above. At this time, a rear end portion of the wider part 914 (shown by one-dot chain line in FIG. 6) of the actuation part 913 is located within the locking hole 931 of the lock member 93 disposed behind the guide wall 921. The locking hole 931 and the wider part 914 have substantially the same width in the left-right direction as described above. For this reason, even if the user presses the left or right end portion of the body 930, the wider part 914 interferes with the body 930 of the lock member 93 and thereby prevents the body 930 from moving in the left-right direction. In other words, in this embodiment, the foremost position of the linked member 91 corresponds to an inhibiting position in which the linked member 91 inhibits the lock member 93 from moving. At this time, the lock member 93 is in the non-locking position as shown in FIG. 6. Therefore, the trigger 14 returns to the OFF position when the user releases the trigger 14 after the user presses the trigger 14 to the ON position.

As shown in FIG. 4, when the mode switching dial 4 is switched to the hammer-mode position, the linked member 91 is moved to the rearmost position as described above. At this time, the narrower part 915 (shown by solid line in FIG. 6) of the actuation part 913 is disposed within the locking hole 931. As described above, the narrower part 915 has a narrower width than the locking hole 913 in the left-right direction. For this reason, a clearance is formed between the narrower part 915 and an inner wall of the body 930 on each of the right and left sides of the narrower part 915. In other words, the narrower part 915 is spaced apart from the inner wall of the body 930 in the left-right direction, so that the lock member 93 is allowed to move in the left-right direction. Therefore, in this embodiment, the rearmost position of the linked member 91 corresponds to an allowing position in which the linked member 91 allows the lock member 93 to move. Further, as shown in FIG. 6, even if the linked member 91 is placed in the allowing position, the lock member 93 is held in the non-locking position by the biasing force of the biasing member 95 as described above.

Figure 7:
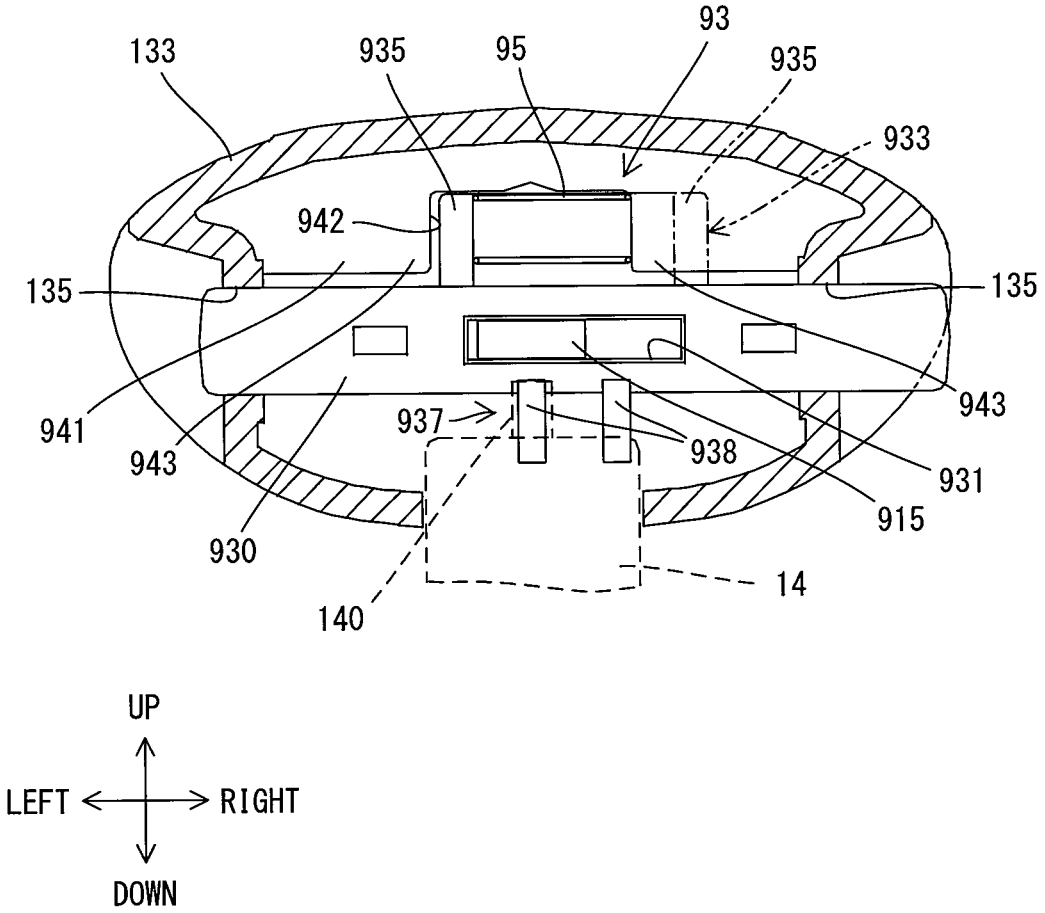
FIG. 7 is a sectional view that corresponds to FIG. 6, for illustrating a state in which the trigger is placed in an ON position and the lock member is placed in a right locking position.

In this state, when the user presses the trigger 14 to turn the trigger 14 from the OFF position to the ON position and then presses the left end portion of the body 930 of the lock member 93, the lock member 93 is moved to the right against the biasing force of the biasing member 95, as shown in FIG. 7. The biasing member 95 is compressed between the left stopper part 935 of the spring holding part 933 and the right spring pressing part 943 of the restricting wall 941. As a result, the left projection piece 938 of the lock member 93 is moved to the locking position on the movement path of the locking projection 140 of the trigger 14. In this state, when the user releases the trigger 14, the trigger 14 is biased by the plunger of the switch 145 and moved forward, so that a front end surface of the locking projection 140 abuts against a rear end surface of the left projection piece 938 from the rear. In this embodiment, the plunger is configured to have a larger biasing force than the biasing member 95, so that the trigger 14 is locked in the ON position by the biasing force of the plunger.

Even if the mode switching dial 4 is switched to the hammer-mode position and the linked member 91 is placed in the allowing position, the locking projection 140 of the trigger 14 is disposed between the two projection pieces 938 when the trigger 14 is in the OFF position as shown in FIG. 3. Therefore, when the lock member 93 is operated without turning the trigger 14 to the ON position, the locking projection 140 comes in contact with one of the projection pieces 938, so that the lock member 93 is prevented from moving in the left-right direction.

Figure 8:
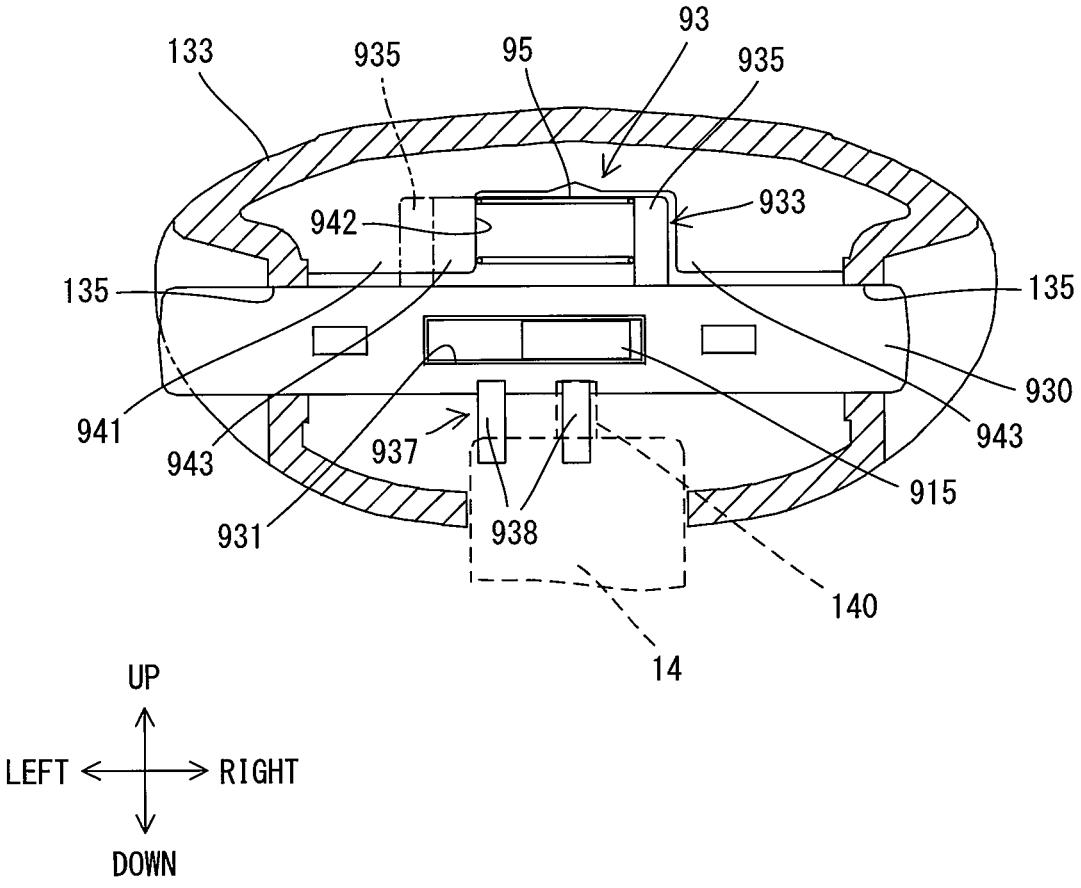
FIG. 8 is a sectional view that corresponds to FIG. 6, for illustrating a state in which the trigger is placed in the ON position and the lock member is placed in a left locking position.

As shown in FIG. 8, when the user presses the right end portion of the body 930, the lock member 93 is moved to the left and the right projection piece 938 of the lock member 93 is moved to the locking position on the movement path of the locking projection 140 of the trigger 14. Therefore, when the user releases the trigger 14, the trigger 14 is locked in the ON position.

When the user presses the trigger 14 locked in the ON position so as to turn the trigger 14 to the rearmost position, the projection piece 938 of the lock member 93 is disengaged from the locking projection 140. As a result, the lock member 93 is returned to the non-locking position by the biasing force of the biasing member 95, which has been compressed along with the leftward or rightward movement of the lock member 93.

In this embodiment, as shown in FIG. 4, the length of the narrower part 915 in the direction of the drive axis A1 (front-rear direction) is set longer than the length of the body 930 of the lock member 93 in the front-rear direction. When the linked member 91 is placed in the allowing position, the narrower part 915 protrudes from the body 930 in the front-rear direction. This protruding part is configured as an interference preventing part for preventing interference between the linked member 91 and the lock member 93 when the second housing 13 moves relative to the first housing 11 in the direction of the drive axis A1 (front-rear direction).

As described above, the linked member 91 is connected to the mode switching dial 4, which is disposed on the first housing 11, while the lock member 93 is held by the second housing 13 which is elastically connected to the first housing 11. When the first housing 11 vibrates, the linked member 91 also vibrates. On the other hand, the second housing 13 does not vibrate in synchronization with the first housing 11. Therefore, with the structure in which the narrower part 915 is formed longer in the front-rear direction to provide the interference preventing part, it is possible to prevent the lock member 93 from interfering with the wider part 914 or the guide part 916 and thus from being inhibited from moving, when the linked member 91 is placed in the allowing position.

As described above, the hammer drill 1 of this embodiment has the mode switching dial 4, the switch 145, the trigger 14 and the trigger lock mechanism 9. The hammer drill 1 is configured such that one of the hammer mode and the hammer drill mode is selectable by switching the mode switching dial 4 between the hammer-mode position and the hammer-drill-mode position. The trigger 14 is configured to be normally held in the OFF position for holding the switch 145 in the off-state, and to be moved to the ON position for holding the switch 145 in the on-state, in response to a user's external pressing operation. The trigger lock mechanism 9 includes: the lock member 93 which can move between the locking position in which the lock member 93 can lock the trigger 14 in the ON position and the non-locking position in which the lock member 93 cannot lock the trigger 14 in the ON position; and the linked member 91 which is configured to move between the inhibiting position for inhibiting the movement of the lock member 93 and the allowing position for allowing the movement of the lock member 93, linked to the switching operation of the mode switching dial 4.

When the hammer mode is selected with the mode switching dial 4, the linked member 91 moves to the allowing position. Therefore, the user can lock the trigger 14 in the ON position by moving the lock member 93 to the locking position. When the hammer drill mode is selected with the mode switching dial 4, the linked member 91 moves to the inhibiting position. Therefore, the user cannot move the lock member 93 to the locking position, even if the user tries to do so. This allows the user to intuitively and directly recognize that it is impossible to lock the trigger 14 in the ON position in the selected hammer drill mode. Thus, an interactive working environment is provided, so that the user's operation feeling can be improved.

In this embodiment, the trigger lock mechanism 9 includes the biasing member 95 which biases the lock member 93 to hold the lock member 93 in the non-locking position. When the lock member 93 is placed in the locking position against the biasing force of the biasing member 95, the lock member 93 locks the trigger 14 in the ON position by abutting against the trigger 14 (more specifically, the locking projection 140). Therefore, even when the linked member 91 is placed in the allowing position, the lock member 93 is held in the non-locking position unless the lock member 93 is moved to the locking position against the biasing force of the biasing member 95. With such a structure, the trigger 14 is prevented from being locked in the ON position when not intended by the user. Further, when the lock member 93 (more specifically, the trigger locking part 937) is disengaged from the trigger 14 (more specifically, the locking projection 140), the lock member 93 can be returned from the locking position to the non-locking position by the biasing force of the biasing member 95.

In this embodiment, the lock member 93 is movable in the left-right direction crossing the drive axis A1 and the left and right end portions of the lock member 93 can be externally operated. The locking positions are provided on opposite sides (i.e. on the left side and the right side) of the non-locking position in the left-right direction. Therefore, when the lock member 93 is held in the non-locking position by the biasing member 95, the user can lock the trigger 14 in the ON position by operating the lock member 93 from either side in the left-right direction thereby moving the lock member 93 to one of the locking positions. Consequently, operability can be improved.

In this embodiment, the linked member 91 is configured to move in the direction of the drive axis A1 (front-rear direction), linked to the switching operation of the mode switching dial 4, and the lock member 93 is movable in the direction (left-right direction) crossing the drive axis A1. The linked member 91 includes the wider part 914 having a prescribed width in the left-right direction and the narrower part 915 having a narrower width than the prescribed width in the left-right direction. When the linked member 91 is placed in the inhibiting position, the wider part 914 comes in contact with the lock member 93 in the left-right direction and thereby inhibits the lock member 93 from moving in the left-right direction. Further, when the linked member 91 is placed in the allowing position, the narrower part 915 is spaced apart from the lock member 93 in the left-right direction and thereby allows the lock member 93 to move in the left-right direction. In this manner, with the simple structure of providing the linked member 91 with the wider part 914 and the narrower part 915, the movement of the lock member 93 which is movable in the left-right direction can be inhibited or allowed simply by moving the linked member 91 to the inhibiting position or the allowing position in the front-rear direction. Therefore, the number of parts constituting the trigger lock mechanism 9 can be made relatively small.

In this embodiment, the housing 10 includes the first housing 11 that houses the driving mechanism 3, and the second housing 13 that includes the grip part 131 and is connected to the first housing 11 via the elastic element such that the second housing 13 is movable relative to the first housing 11. The linked member 91 is connected to the mode switching dial 4, which is provided to the first housing 11, such that the linked member 91 moves in conjunction with the mode switching dial 4. Further, the lock member 93 is provided to the second housing 13. A portion of the narrower part 915 of the linked member 91 is configured as the interference preventing part to prevent the linked member 91 and the lock member 93 from interfering with each other in the direction of the relative movement of the first and second housings 11 and 13 (the direction of the drive axis A1) when the linked member 91 is placed in the allowing position and the second housing 13 moves with respect to the first housing 11. Therefore, when the linked member 91 is placed in the allowing position, the lock member 93 is prevented from interfering with the linked member 91 and thus from being inhibited from moving.

Correspondences between the features of the embodiment and the features of the teachings are as follows. The hammer drill 1 is an example that corresponds to the "hammer drill" according to the present teachings. The switch 145 is an example that corresponds to the "switch" according to the present teachings. The trigger 14 is an example that corresponds to the "operation member" according to the present teachings. The lock member 93 is an example that corresponds to the "lock member" according to the present teachings. The mode switching dial 4 is an example that corresponds to the "mode switching member" according to the present teachings. The hammer mode and the hammer drill mode are examples that correspond to the "hammer mode" and the "drill mode", respectively, according to the present teachings. The linked member 91 is an example that corresponds to the "linked member" according to the present teachings.

The wider part 914 and the narrower part 915 are examples that correspond to the "wider part" and the "narrower part", respectively, according to the present teachings. The biasing member 95 is an example that corresponds to the "biasing member" according to the present teachings. The driving mechanism 3 is an example that corresponds to the "driving mechanism" according to the present teachings. The first housing 11, the second housing 13 and the grip part 131 are examples that correspond to the "first housing", the "second housing" and the "grip part", respectively, according to the present teachings. Each of the first springs 71, the second spring 75 and the O-ring 79 is an example that corresponds to the "elastic element" according to the present teachings. The portion of the narrower part 915 which is configured as the interference preventing part is an example that corresponds to the "interference preventing part" according to the present teachings.

The above-described embodiment is a mere example of the teachings and an impact tool according to the present teachings is not limited to the structure of the hammer drill 1 of the above-described embodiment. For example, the following modifications may be made. Further, one or more of these modifications may be used in combination with the hammer drill 1 of the above-described embodiment or the claimed hammer drill.

For example, in the hammer drill 1, a brushless DC motor which is powered by the battery 19 is employed as the motor 2, which is a driving source for driving the tool accessory 18, but an AC motor having a brush may be employed instead. In such a case, the hammer drill 1 may have a power cable for connecting to an external power source in place of the battery mounting parts 15. Further, when the battery 19 is used as the power source, the number of the battery mounting parts 15 needs not necessarily be two. The structure of the driving mechanism 3 which is powered by the motor 2 to drive the tool accessory 18 may also be appropriately modified. For example, in place of the above-described crank mechanism, the motion converting mechanism 30 may be of the type that converts rotational motion of the motor 2 into linear motion by using a swinging member.

Further, the structure of the housing 10 is not limited to the structure of the above-described embodiment, but may be appropriately modified or changed. For example, the shapes of the first housing 11 and the second housing 13 which is connected to the first housing 11 via the elastic element in a relatively movable manner, and the structures, the number and the positions of the elastic elements (the first springs 71, the second spring 75, the O-ring 79) and the sliding guides (the upper sliding part 81, the lower sliding part 82) may be appropriately changed. Further, it is preferable for the housing 10 to have a vibration-isolating housing structure, but this is not essential.

In the above-described embodiment, the drive modes which can be selected with the mode switching dial 4 includes the hammer mode in which only the hammering operation is performed and the hammer drill mode in which the hammering operation and the drilling operation are performed. In addition to these modes, a drill mode in which only the drilling operation is performed may be selectable. Alternatively, either one of the hammer mode and the drill mode may be selectable. In any of these cases, the linked member 91 may to be moved to the allowing position when the hammer mode is selected, while the linked member 91 may be moved to the inhibiting position when the drive mode involving the drilling operation (the hammer drill mode or the drill mode) is selected. Further, in place of the mode switching dial 4 which is turned (rotated) to switch among a plurality of switching positions, a mode switching lever which is linearly moved in a prescribed direction may be employed.

The structure of the trigger lock mechanism 9 may also be appropriately changed. For example, the linked member 91 only needs to be movable between the inhibiting position for inhibiting the movement of the lock member 93 and the allowing position for allowing the movement of the lock member 93, linked to the switching operation of the mode switching dial 4. The shape of the linked member 91, the connection manner of the linked member 91 with the mode switching dial 4 and the operation manner of the linked member 91 with respect to the lock member 93 are not limited to those of the above-described embodiment. Similarly, the lock member 93 only needs to be movable between the locking position in which the trigger 14 can be locked in the ON position and the non-locking position in which the trigger 14 cannot be locked in the ON position, in response to an external operation. The shape of the lock member 93 and the arrangement of the lock member 93 with respect to the linked member 91 are not limited to those of the above-described embodiment.

For example, in the above-described embodiment, the linked member 91 of the trigger lock mechanism 9 is connected to the first housing 11 via the mode switching dial 4, while the lock member 93 is disposed in the second housing 13 which is different from the first housing 11. Therefore, a portion of the narrower part 915 is configured as the interference preventing part, but the linked member 91 and the lock member 93 may be disposed in the same housing. Further, the linked member 91 may not necessarily have the interference preventing part.

Further, in the linked member 91, for example, the narrower part 915 may be disposed in its rear end region (on the lock member 93 side), while the wider part 914 may be disposed in front of the narrower part 915 (on the mode switching dial 4 side). In such a case, the linked member 91 may be moved forward and the narrower part 915 may be placed in the allowing position within the locking hole 931 when the mode switching dial 4 is switched to the hammer-mode position. The linked member 91 may be moved rearward and the wider part 914 may be placed in the inhibiting position within the locking hole 931 when the mode switching dial 4 is switched to the hammer-drill-mode position.

Further, in the above-described embodiment, the lock member 93 has the two projection pieces 938 as the trigger locking part 937. As a result, when the lock member 93 is moved to either side of the non-locking position in the direction (left-right direction) crossing the moving direction of the linked member 91 (the direction of the drive axis A1, the front-rear direction), the lock member 93 can be moved to the locking position. The trigger locking part 937, however, may include only one projection piece 938 such that the lock member 93 can be moved to the locking position only when the lock member is moved to one side of the non-locking position in the left-right direction. In such a case, the shape of the actuation part 913 of the linked member 91 may be appropriately changed. Further, in the above-described embodiment, the lock member 93 is configured to be held in the non-locking position by the biasing force of the biasing member 95, but the biasing member 95 does not need to be provided.

In view of the natures of the present teachings and the above-described embodiment, the following aspects can be provided. Each of the aspects can be used in combination with the hammer drill 1 of the above-described embodiment, any one of the above-described modifications and the claimed hammer drill.

(Aspect 1)

The linked member may be configured to move in the drive axis direction, linked to the switching operation of the mode switching member, the lock member may be configured to move in a crossing direction crossing the drive axis, and the linked member may be configured to come in contact with the lock member in the crossing direction to thereby inhibit the lock member from moving in the crossing direction when the linked member is placed in the inhibiting position, and the linked member may be configured to be spaced apart from the lock member in the crossing direction to thereby allow the lock member to move in the crossing direction when the linked member is placed in the allowing position.

(Aspect 2)

The lock member may include a trigger locking part, the lock member may be configured such that the trigger locking part is placed in a position deviated from a movement path of the operation member when the lock member is placed in the non-locking position, and such that the trigger locking part is placed on the movement path of the operation member when the lock member is placed in the locking position.

DESCRIPTION OF THE NUMERALS

1: hammer drill
2: motor
25: motor shaft
29: driving gear
3: driving mechanism
30: motion converting mechanism
31: crank shaft
311: driven gear
312: crank pin
32: connecting rod
33: piston
34: tool holder
35: cylinder
36: striking mechanism
361: striker
363: impact bolt
365: air chamber
38: rotation transmitting mechanism
39: clutch
4: mode switching dial
41: eccentric shaft
45: rotation path
5: controller
71: first spring
75: second spring
79: O-ring
81: upper sliding part
82: lower sliding part
9: trigger lock mechanism
91: linked member
910: connection part
911: guide hole
913: actuation part
914: wider part
915: narrower part
916: guide part
921: guide wall
922: passage
923: guide rib
93: lock member
930: body
931: locking hole
933: spring holding part
934: recess
935: stopper part
937: trigger locking part
938: projection piece
941: restricting wall
942: recess
943: spring pressing part
95: biasing member

10: housing
11: first housing
111: motor housing part
117: driving mechanism housing part
13: second housing
131: grip
133: upper part
134: opening
135: through hole
137: lower part
14: trigger
140: locking projection
141: support shaft
145: switch
15: battery mounting part
18: tool accessory
19: battery

What is claimed is:

1. A hammer drill having a selectable plurality of drive modes including a hammer mode and a drill mode and configured to operate according to a selected one of the plurality of drive modes, the hammer mode being a drive mode in which only a hammering operation to linearly drive a tool accessory in a direction of a drive axis is performed, the drill mode being a drive mode in which at least a drilling operation to rotationally drive the tool accessory around the drive axis is performed, the hammer drill comprising:

a switch for driving the tool accessory;

an operation member configured to be normally held in an OFF position and to move to an ON position in response to an external pressing operation, the operation member in the OFF position holding the switch in an off-state, and the operation member in the ON position holding the switch in an on-state;

a mode switching member configured to be switched among a plurality of switching positions in response to a first external manual operation by a user, the plurality of switching positions respectively corresponding to the plurality of drive modes;

a lock member configured to move between a locking position and a non-locking position in response to a second external manual operation by the user that is different from the first external manual operation, the lock member in the locking position being capable of locking the operation member in the ON position, and the lock member in the non-locking position being incapable of locking the operation member in the ON position; and a linked member configured to move between an inhibiting position and an allowing position and linked to a switching operation of the mode switching member, the linked member in the inhibiting position inhibiting a movement of the lock member, the linked member in the allowing position allowing the movement of the lock member, wherein:

the linked member is configured to move to the allowing position when the mode switching member is switched to one of the switching positions corresponding to the hammer mode; and the linked member is configured to move to the inhibiting position when the mode switching member is switched to one of the switching positions corresponding to the drill mode.

2. The hammer drill as defined in claim 1, further comprising:

a biasing member biasing the lock member so as to hold the lock member in the non-locking position, wherein:

the lock member is configured to lock the operation member in the ON position by abutting against the operation member when the lock member is placed in the locking position against a biasing force of the biasing member.

3. The hammer drill as defined in claim 2, wherein:

the lock member is configured to move in a crossing direction crossing the drive axis, and configured such that both ends of the lock member in the crossing direction are externally operable;

the lock member is further configured to move between another locking position and the non-locking position; and the locking position and the other locking position are provided on opposite sides of the non-locking position in the crossing direction.

4. The hammer drill as defined in claim 1, wherein:

the linked member is configured to move in the direction of the drive axis and is linked to the switching operation of the mode switching member;

the lock member is configured to move in a crossing direction crossing the drive axis, the linked member has a wider part having a prescribed width in the crossing direction and a narrower part having a narrower width than the prescribed width in the crossing direction;

the wider part is configured to come in contact with the lock member in the crossing direction to thereby inhibit the lock member from moving in the crossing direction when the linked member is placed in the inhibiting position; and the narrower part is configured to be spaced apart from the lock member in the crossing direction to thereby allow the lock member to move in the crossing direction when the linked member is placed in the allowing position.

5. The hammer drill as defined in claim 1, further comprising:

a driving mechanism configured to drive the tool accessory;

a first housing that houses the driving mechanism; and a second housing including a grip part configured to be held by the user, the second housing being connected to the first housing via an elastic element such that the second housing is movable relative to the first housing, wherein:

the mode switching member is provided to the first housing;

the linked member is connected to the mode switching member such that the linked member moves in conjunction with the mode switching member;

the lock member is provided to the second housing; and the linked member has an interference preventing part configured to prevent the linked member and the lock member from interfering with each other in a direction of a relative movement of the first and second housings when the linked member is placed in the allowing position and the second housing moves relative to the first housing.

6. The hammer drill as defined in claim 1, wherein:

the linked member is configured to move in the drive axis direction; and is linked to the switching operation of the mode switching member;

the lock member is configured to move in a crossing direction crossing the drive axis, the linked member is configured to come in contact with the lock member in the crossing direction to thereby inhibit the lock member from moving in the crossing direction when the linked member is placed in the inhibiting position; and the linked member is configured to be spaced apart from the lock member in the crossing direction to thereby allow the lock member to move in the crossing direction when the linked member is placed in the allowing position.

7. The hammer drill as defined in claim 6, wherein:

the lock member has a through hole extending through the lock member in the direction of the drive axis; and the linked member is configured to move in the through hole in the direction of the drive axis and is linked to the switching operation of the mode switching member.

8. The hammer drill as defined in claim 1, wherein:

the lock member includes a trigger locking part;

the trigger locking part is placed in a position deviated from a movement path of the operation member when the lock member is placed in the non-locking position, the movement path being a path along which the operation member moves between the ON position and the OFF position; and the trigger locking part is placed on the movement path of the operation member when the lock member is placed in the locking position.

9. The hammer drill as defined in claim 1, wherein the lock member comprises a portion that protrudes from a housing of the hammer drill; and the user can move the lock member between the locking position and the non-locking position by engaging the portion during the second external manual operation.

10. The hammer drill as defined in claim 1, wherein the lock member is configured to move in a crossing direction crossing the drive axis.

11. A hammer drill having a selectable plurality of drive modes including a hammer mode and a drill mode and configured to operate according to a selected one of the plurality of drive modes, the hammer mode being a drive mode in which only a hammering operation to linearly drive a tool accessory in a direction of a drive axis is performed, the drill mode being a drive mode in which at least a drilling operation to rotationally drive the tool accessory around the drive axis is performed, the hammer drill comprising:

a switch for driving the tool accessory;

an operation member configured to be normally held in an OFF position and to move to an ON position in response to an external pressing operation, the operation member in the OFF position holding the switch in an off-state, and the operation member in the ON position holding the switch in an on-state;

a mode switching member configured to be switched among a plurality of switching positions in response to a first external operation, the plurality of switching positions respectively corresponding to the plurality of drive modes;

a lock member configured to move between a locking position and a non-locking position in response to a second external operation, the lock member in the locking position being capable of locking the operation member in the ON position, and the lock member in the non-locking position being incapable of locking the operation member in the ON position;

a linked member configured to move between an inhibiting position and an allowing position and linked to a switching operation of the mode switching member, the linked member in the inhibiting position inhibiting a movement of the lock member, the linked member in the allowing position allowing the movement of the lock member; and a biasing member biasing the lock member so as to hold the lock member in the non-locking position, wherein:

the linked member is configured to move to the allowing position when the mode switching member is switched to one of the switching positions corresponding to the hammer mode;

the linked member is configured to move to the inhibiting position when the mode switching member is switched to one of the switching positions corresponding to the drill mode;

the lock member is configured to lock the operation member in the ON position by abutting against the operation member when the lock member is placed in the locking position against a biasing force of the biasing member; and the lock member is configured to move in a crossing direction crossing the drive axis, and configured such that both ends of the lock member in the crossing direction are externally operable.

12. A hammer drill having a selectable plurality of drive modes including a hammer mode and a drill mode and configured to operate according to a selected one of the plurality of drive modes, the hammer mode being a drive mode in which only a hammering operation to linearly drive a tool accessory in a direction of a drive axis is performed, the drill mode being a drive mode in which at least a drilling operation to rotationally drive the tool accessory around the drive axis is performed, the hammer drill comprising:

a switch for driving the tool accessory;

an operation member configured to be normally held in an OFF position and to move to an ON position in response to an external pressing operation, the operation member in the OFF position holding the switch in an off-state, and the operation member in the ON position holding the switch in an on-state;

a mode switching member configured to be switched among a plurality of switching positions in response to a first external operation, the plurality of switching positions respectively corresponding to the plurality of drive modes;

a lock member configured to move between a locking position and a non-locking position in response to a second external operation, the lock member in the locking position being capable of locking the operation member in the ON position, and the lock member in the non-locking position being incapable of locking the operation member in the ON position; and a linked member configured to move between an inhibiting position and an allowing position and linked to a switching operation of the mode switching member, the linked member in the inhibiting position inhibiting a movement of the lock member, the linked member in the allowing position allowing the movement of the lock member, wherein:

the linked member is configured to move to the allowing position when the mode switching member is switched to one of the switching positions corresponding to the hammer mode;

the linked member is configured to move to the inhibiting position when the mode switching member is switched to one of the switching positions corresponding to the drill mode;

the linked member is configured to move in the drive axis direction and is linked to the switching operation of the mode switching member;

the lock member is configured to move in a crossing direction crossing the drive axis;

the linked member is configured to come in contact with the lock member in the crossing direction to thereby inhibit the lock member from moving in the crossing direction when the linked member is placed in the inhibiting position; and the linked member is configured to be spaced apart from the lock member in the crossing direction to thereby allow the lock member to move in the crossing direction when the linked member is placed in the allowing position.

13. The hammer drill as defined in claim 12, wherein:

the linked member is configured to move in the direction of the drive axis and is linked to the switching operation of the mode switching member;

the lock member is configured to move in the crossing direction crossing the drive axis, the linked member has a wider part having a prescribed width in the crossing direction and a narrower part having a narrower width than the prescribed width in the crossing direction;

the wider part is configured to come in contact with the lock member in the crossing direction to thereby inhibit the lock member from moving in the crossing direction when the linked member is placed in the inhibiting position; and the narrower part is configured to be spaced apart from the lock member in the crossing direction to thereby allow the lock member to move in the crossing direction when the linked member is placed in the allowing position.

14. The hammer drill as defined in claim 12, wherein:

the lock member has a through hole extending through the lock member in the direction of the drive axis; and the linked member is configured to move in the through hole in the direction of the drive axis and is linked to the switching operation of the mode switching member.

* * * * *